United States Patent [19]

Pfeifer et al.

[11] 4,021,668

[45] May 3, 1977

[54] IONOGRAPHY IMAGING CHAMBER

[75] Inventors: Josef Pfeifer, Unterhaching; Alfred Rheude, Munich; Kurt Thate, Munich; Jürgen Müller, Munich, all of Germany

[73] Assignee: AGFA-Gevaert, A.G., Leverkusen, Germany

[22] Filed: Mar. 12, 1976

[21] Appl. No.: 666,410

[30] Foreign Application Priority Data

Mar. 26, 1975 Germany ..... 2513292

[52] U.S. Cl. ..... 250/315 A

[51] Int. Cl.[2] ..... G03G 13/00; G03G 15/00

[58] Field of Search ..... 250/315 A, 335

[56] References Cited

UNITED STATES PATENTS

| | | | |
|---|---|---|---|
| 3,859,529 | 1/1975 | Proudian et al. | 250/315 A |
| 3,873,833 | 3/1975 | Allan et al. | 250/315 A |

*Primary Examiner*—Alfred E. Smith
*Assistant Examiner*—T. N. Grigsby
*Attorney, Agent, or Firm*—Peter K. Kontler; John Kurucz

[57] ABSTRACT

An ionography imaging chamber for use in the cassette of an X-ray apparatus has a flat prismatic pressure vessel defining an interelectrode gap for compressed high Z gas and a dielectric charge-receiving sheet which is to be exposed to a pattern of X-rays. The pressure vessel fits into the compartment of a strongly deformation-resistant jacket having a centrally located sleeve consisting primarily of polyurethane foam, a thin tubular inner envelope which consists at least in part of convoluted fibrous material, and a thin tubular outer envelope which also consists at least in part of convoluted fibrous material. That envelope which takes up compressive stresses has a layer of carbon epoxy fibers. The other envelope takes up tensional stresses and contains Kevlar fibers. The pressure vessel has two flat tray-shaped main portions which consist of polyurethane foam. The main portions of the pressure vessel and/or the sleeve of the jacket may be strengthened by inserts consisting of metal or a synthetic plastic material with fibrous reinforcements embedded therein.

26 Claims, 5 Drawing Figures

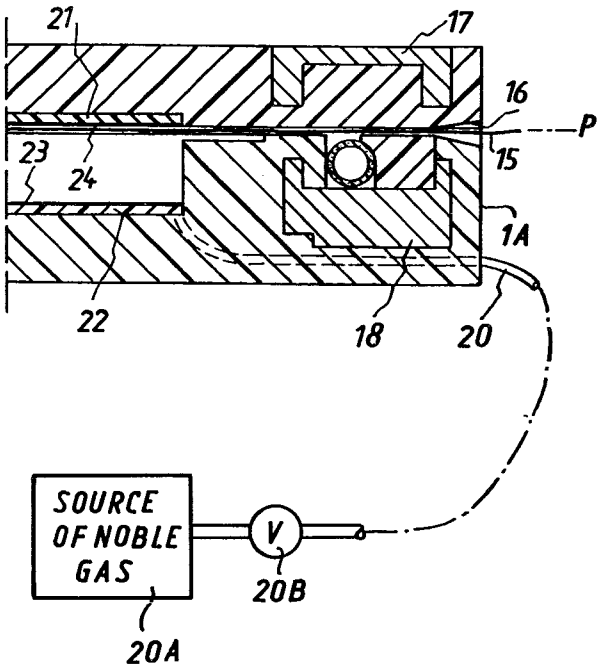
Fig.4
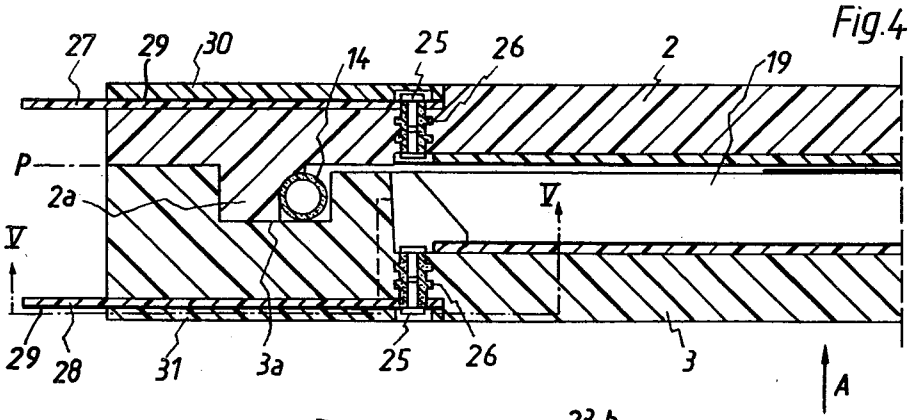
Fig.5
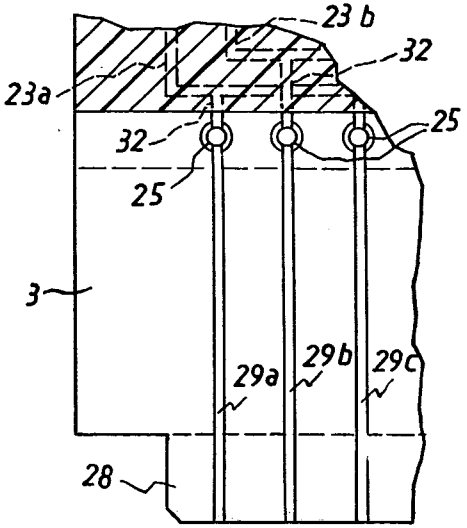

IONOGRAPHY IMAGING CHAMBER

BACKGROUND OF THE INVENTION

The present invention relates to improvements in apparatus for making X-ray images without resorting to X-ray film, and more particularly to improvements in ionography imaging chambers of the type wherein a dielectric receptor sheet or an analogous insulating charge-receiving medium is placed into an interelectrode gap which is defined by an anode and a cathode and contains a high Z gas. During imaging, the gas is maintained at an elevated (superatmospheric) pressure and serves to absorb incident X-rays.

In an imaging system of the above outlined character, the compressed high Z gas (e.g., Freon, Krypton or Xenon) plays the important role of absorbing X-rays to effect the generation of a charge by a quantum process, such as the photoelectric or Compton effect. The thus produced charge results in development of a latent electrostatic image on the dielectric sheet which is located in the electric field between the electrodes. The latent image on the sheet is made visible by an electrostatic technique including the deposition of toner particles.

In order to achieve a satisfactory yield as well as to reduce the exposure of patients to X-rays, presently known ionography imaging chambers are operated at a gas pressure of 6–20 atmospheres. Thus, the walls of the imaging chamber must withstand a very high internal pressure. At the same time, such walls (and especially the wall which extends across the path of incident X-rays must be sufficiently thin to minimize absorption and/or lateral diffusion (scattering) of X-rays. Therefore, conventional imaging chambers employ a relatively thin membrane or pane which consists of beryllium and is inserted into a window provided in the front wall or lid of the chamber. The marginal portions of the membrane are clamped in a solid frame which is installed in the window. That portion of the front wall which surrounds the window and receives and retains the frame is rather strong and bulky. Moreover, the membrane is expensive, not only because of the cost of its material but also because the material is brittle so that it must be machined with great care. The means for securing the membrane to the frame, for securing the frame to the front wall, and for securing the front wall to the rear wall or base of the imaging chamber comprises a large number of screws or analogous fasteners which interfere with access to the interior of the imaging chamber during assembly, insertion and/or maintenance of its component parts.

SUMMARY OF THE INVENTION

An object of the invention is to provide a novel and improved ionography imaging chamber which can be used in the cassette of an X-ray apparatus, which absorbs and/or scatters a surprisingly low percentage of incident X-rays, and which is simple, light-weight and inexpensive while being capable of withstanding all stresses which arise when its interelectrode gap is filled with a highly compressed gas.

Another object of the invention is to provide a light-weight imaging chamber which can be dismantled and reassembled without resorting to special tools and in a time-saving manner.

A further object of the invention is to provide an ionography imaging chamber which can establish a reliable fluid-tight seal around the interelectrode gap when the latter is filled with a compreessed high Z gas.

An additional object of the invention is to provide an imaging chamber with novel and improved means for connecting its electrodes with a high-voltage supply.

Still another object of the invention is to provide novel and improved means for sealing the interelectrode gap of an ionography imaging chamber and novel and improved means for preventing expansion of the interelectrode gap in response to pressure of the confined gaseous medium.

The invention is embodied in an ionography imaging chamber for use in an X-ray system wherein information is recorded as a pattern of electrostatic charges carried by an insulating charge-receiving medium (e.g., a dielectric sheet) while the medium is placed into a gap between spaced apart first and second electrodes and the gap is filled with a compressed ionizable gas which has a high Z. The imaging chamber is adapted to be exposed to a pattern of X-rays (e.g., by being insertable into a customary cassette) and comprises two main sections, namely a pressure vessel which receives the electrodes and defines the aforementioned gap and has sealing means (e.g., one or more inflatable gaskets) surrounding the gap to confine the compressed gas therein whereby the gas tends to expand and to deform the pressure vessel, and means for preventing deformation of the vessel. Such deformation preventing means comprises a sleeve-like or pocket-like jacket which is constructed and configurated to withstand pronounced deforming stresses and has a compartment for the pressure vessel.

At least the major portion of the pressure vessel and/or jacket preferably consists of a lightweight material (e.g., polyurethane foam) which is a poor absorber and scatterer of X-rays. The jacket preferably comprises a medium portion which surrounds a thin inner envelope and is surrounded by a thin outer envelope. One of the envelopes resists tensional stresses and preferably includes Kevlar fibers embedded in a synthetic plastic substance. The other envelope resists compressive stresses and preferably includes carbon epoxy filaments having a high modulus of elasticity.

The novel features which are considered as characteristic of the invention are set forth in particular in the appended claims. The improved imaging chamber itself, however, both as to its construction and the mode of assembling and using the same, together with additional features and advantages thereof, will be best understood upon perusal of the following detailed description of certain specific embodiments with reference to the accompanying drawing.

BRIEF DESCRIPTION OF THE DRAWING

FIG. 4 is a greatly enlarged fragmentary longitudinal sectional view of the first imaging chamber, substantially as seen in the direction of arrows from the line IV—IV of FIG. 1; and FIG. 5 is a fragmentary sectional view, substantially as seen in the direction of arrows from the line V—V of FIG. 4.

DESCRIPTION OF THE PREFERRED EMBODIMENTS

Figure 1:
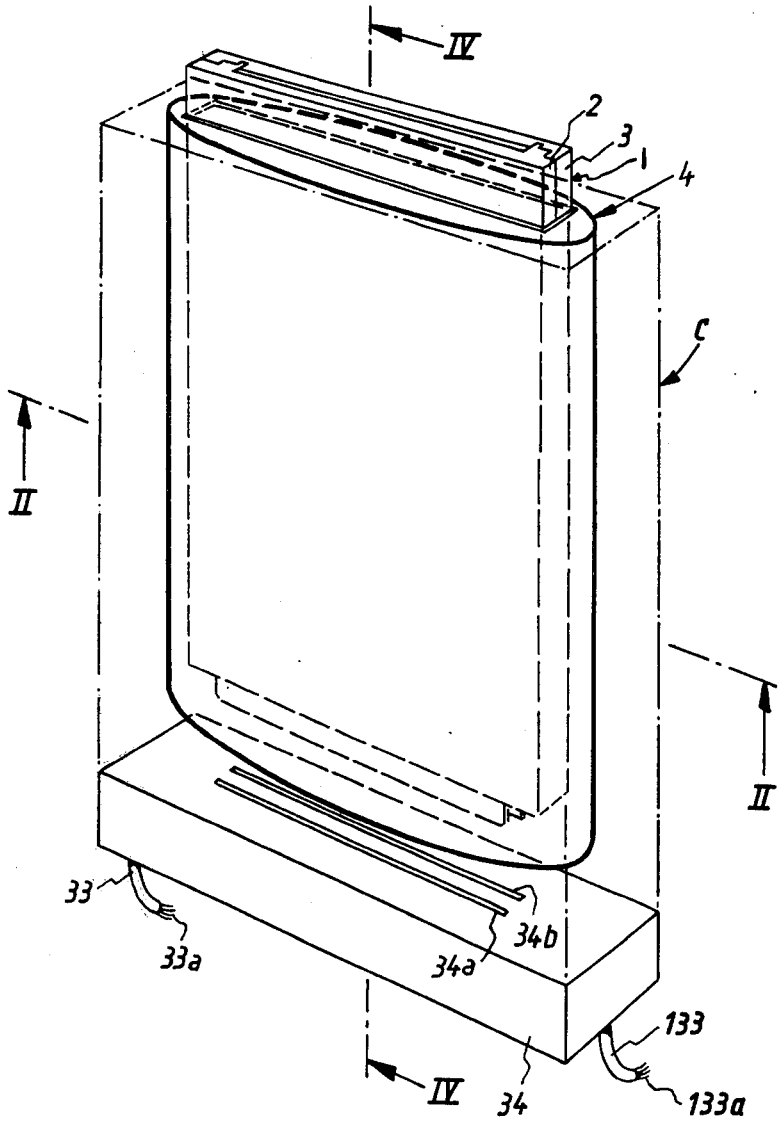
FIG. 1 is a schematic perspective view of a cassette containing an ionography imaging chamber which embodies one form of the invention.
Figure 2:
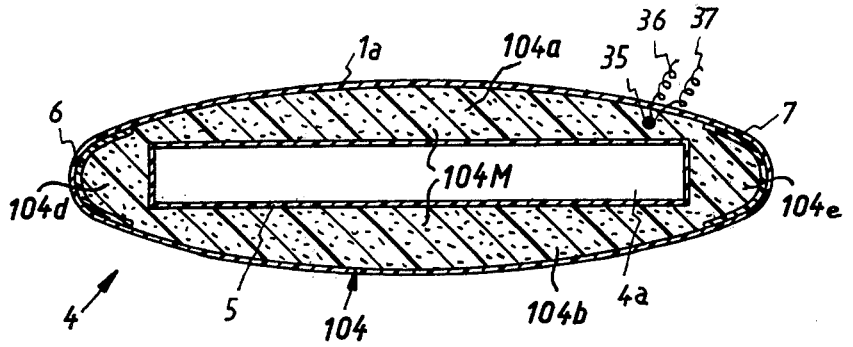
FIG. 2 is an enlarged transverse sectional view of a portion of the imaging chamber, substantially as seen in the direction of arrows from the line II—II of FIG. 1.

Referring to FIGS. 1 and 2, there is shown an ionography imaging chamber which can be inserted into a cassette C (indicated by phantom lines) of the type employed in X-ray equipment. The imaging chamber comprises an inner section or pressure vessel 1 and a substantially prismatic outer section or jacket 4. The pressure vessel 1 comprises two flat tray-shaped main portions or halves 2 and 3 which are interfitted along their marginal zones in a manner shown at the top of FIG. 1. The jacket 4 defines an elongated compartment 4*a* having a substantially square cross-sectional outline and serving to receive the pressure vessel 1 before or while the jacket 4 is inserted into the cassette C. In the embodiment of FIGS. 1 and 2, the jacket 4 is a flat substantially prismatic body with an elliptical outline and includes a sleeve-like median portion 104 (hereinafter called sleeve) which is surrounded by a thin tubular outer envelope 1*a*. The material of the outer envelope 1*a* is subjected primarily to tensional stresses and may consist of or comprise Kevlar (trademark) fibers of the type known as PRD-49 produced by DuPont. It is equally possible to make the outer envelope 1*a* of another synthetic plastic material which is reinforced with filaments and exhibits anisotropic properties. It is important and desirable that the material of the envelope 1*a* exhibit a pronounced tensile strength in the longitudinal direction of its filaments. In accordance with another feature of the invention, the outer envelope 1*a* may be made of carbon epoxy filaments having a high modulus of elasticity and exhibiting a satisfactory strength. Analogously to chemical filaments, such filaments do not cause pronounced absorption and/or scattering of X-rays. Other materials which are suitable for the making of the outer envelope 1*a* are glass fibers and boron fibers with a tungsten core. Such fibers exhibit a highly satisfactory tensile strength; however, they also cause a pronounced weakening of incident X-rays.

The circumferentially complete outer envelope 1*a* renders it possible to utilize filaments which form an endless coiled thread and to distribute the developing stresses among all convolutions with a high degree of uniformity. The transfer of forces which develop in the interior of the pressure vessel 1 to the envelope 1*a* takes place through the medium of sleeve 104.

A thin second or inner envelope 5, consisting of a synthetic plastic material which is reinforced with filaments, is inserted into the sleeve 104 so that it surrounds the compartment 4*a*. It is preferred to employ an inner envelope which constitutes a circumferentially complete tubular body. This inner envelope is intended to take up compressive stresses; therefore, it preferably consists of or embodies carbon filaments. Whereas the outer envelope 1*a* performs the function of preventing the pressure vessel 1 from bursting, the sleeve 104 serves as a means to prevent bulging of the portions 2, 3 which define the gas-filled gap. To this end, the thickness of the sleeve 104 increases from the two narrow sides toward the central portions of the two wide sides of the compartment 4*a*. The regions of maximum thickness of the relatively thin walls 104*a*, 104*b* of the sleeve 104 are indicated at 104M. As mentioned above, the sleeve 104 is confined in the outer envelope 1*a* which resists tensional stresses and the sleeve 104 surrounds the inner envelope 5 which can withstand substantial compressive stresses.

The two longitudinally extending marginal portions 104*d*, 104*e* of the sleeve 104 are bounded by convex outer surfaces having small radii of curvature. These marginal portions are subjected to very pronounced stresses, and such stresses are resisted by arcuate (trough-shaped) reinforcing inserts 6, 7 which may consist of a suitable synthetic plastic material with suitable filaments embedded therein. The inserts 6, 7 are recessed into the outer sides of the respective marginal portions 104*d*, 104*e* and do not overlie the compartment 4*a*, i.e., they are not located in the path of those X-rays which penetrate into the pressure vessel 1. The just described construction of the sleeve 104, coupled with the provision of envelopes 1*a* and 5, enables the jacket 4 to readily withstand stresses which develop due to the fact that the gas which is confined in the pressure vessel 1 between the main portions 2 and 3 is maintained at a pressure of 6–20 atmospheres, and further in spite of the fact that the walls of the sleeve 104 are relatively thin and the jacket 4 is rather large. In an ionography imaging chamber, the area which is subjected to the pressure of confined high Z gas is normally in the range of 20 square decimeters. An additional factor must be considered in the design of imaging chambers is that the full gas pressure of 6–20 atmospheres is normally applied only immediately prior to and during the making of a latent image on the dielectric receptor sheet. This insures that losses due to leakage of the gas are held to a minimum. The resulting fluctuating stresses contribute to premature aging of the material of the imaging chamber. As a rule, the pressure of confined gas during intervals between the making of successive latent images is reduced to one atmosphere superatmospheric pressure (this is the so-called condition of readiness of the imaging chamber).

The envelope 1*a* and/or 5 may be produced by resorting to techniques which have been developed for the making of high-strength components to be used in aircraft and spacecraft. For example, carbon filaments having a thickness of 1–2 microns are assembled into a bundle of one thousand filaments, and the resulting tow is wound onto a wooden pattern or template which is a replica of the sleeve 104 or of a body snugly fitting into the compartment 4*a*. The winding operation proceeds in a manner which is analogous to that of convoluting a wire-like conductor around a core to form a coil. During winding, droplets of epoxy resin are continuously discharged onto the convolutions so that the convolutions are embedded in such material. The speed at which the bundle of filaments is coiled and the rate of admission of epoxy resin are selected with a view to insure that the resulting envelope acquires a thickness which enables it to readily withstand the stresses which arise when the pressure vessel is inserted into the jacket and confines a body of compressed noble gas.

The main portions 2 and 3 of the pressure vessel 1 preferably consist of a homogeneous material (e.g., polyurethane foam) having a low specific weight and being a poor absorber and/or scatterer of X-rays. For example, the specific weight of the material of main portions 2, 3 may be in the range of 0.2–0.5 g/cm$^3$. This insures a minimum of absorption and/or scattering of X-rays which are to impinge on the dielectric receptor sheet. The likelihood of absorption and/or scattering can be reduced still further by employing a pressure vessel whose main portions 2 and 3 are relatively thin; this is possible because the imaging chamber further comprises the jacket 4 which surrounds the pressure vessel during the making of latent images.

The jacket 4 also absorbs a relatively low percentage of X-rays. This is due to the fact that at least some but preferably all or nearly all component parts of the jacket are reinforced by fibers. Such construction renders it possible to reduce the thickness of the jacket which, in turn, results in low rate of X-ray absorption. It has been found that, when taking into consideration its strength, the absorptivity and/or scattering effect of the jacket 4 is surprisingly low.

Another important advantage of the improved imaging chamber is that the component parts of the pressure vessel 1 and/or jacket 4 need be held together by a large number of screws, bolts or analogous fasteners. This renders it possible to dismantle or reassemble the imaging chamber within a small fraction of the time which is needed to perform such operations with conventional imaging chambers.

The outline of the pressure vessel 1 closely resembles the internal surface of the inner envelope 5 so that the vessel fits snugly into the jacket 4 when the improved imaging chamber is installed in the cassette C. The vessel 1 is preferably a prismatic (e.g., flat, substantially brick-shaped) body which is insertable into the compartment 4*a* from above, as viewed in FIG. 1, or from above or below if the compartment is open at both ends. The fact that the compartment 4*a* may be open at both ends does not unduly affect the strength of the jacket 4 because the majority of stresses which the jacket must withstand act at right angles to the inner sides of the walls 104*a*, 104*b* and at right angles to the inner sides of marginal portions 104*d*, 104*e* of the sleeve 104. The utilization of jackets whose components 1*a*, 104 and 5 are open at both ends is preferred at this time on the additional ground that such jackets can be produced at a lower cost. However, it is equally within the scope of the invention to employ a pocket-shaped jacket one end of which is closed save for the provision of slits for blade-like supports 27, 28 which are shown in FIG. 4. The strength of a pocket-shaped jacket is even more satisfactory than that of a jacket which is open at both ends.

Figure 3:
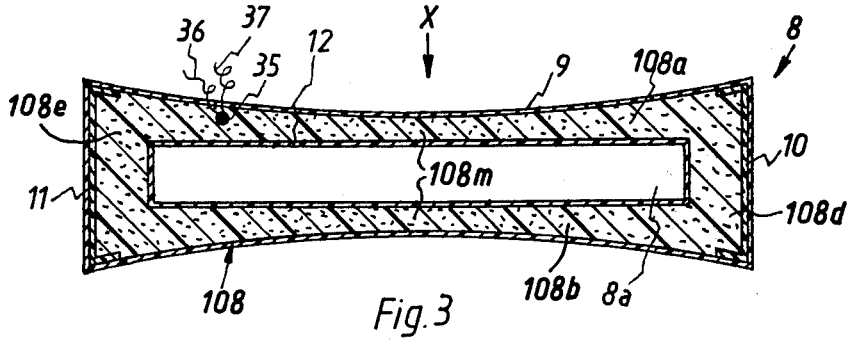
FIG. 3 is a similar transverse sectional view of a portion of a modified imaging chamber.

FIG. 3 shows a modified jacket 8. This jacket defines a compartment 8*a* whose dimensions preferably match the dimensions of the compartment 4*a* so that it can receive the pressure vessel 1 of FIG. 1. The two larger walls 108*a*, 108*b* of the sleeve 108 of the jacket 8 have concave outer surfaces. The direction of incidence of X-rays is indicated by the arrow X.

The sleeve 108 is surrounded by a circumferentially complete outer envelope 9, and it surrounds a circumferentially complete inner envelope 12. The marginal portions 108*d*, 108*e* of the sleeve 108 are reinforced by substantially U-shaped inserts 10 and 11 which are recessed into the outer sides of the respective marginal portions. The outer envelope 9 takes up stresses which arise due to confinement of compressed high Z gas in the interior of the pressure vessel. The portions of minimum thickness of the sleeve 108 are located in an optimum region (at 108*m*), insofar as the direction of incident X-rays is concerned. This insures that the sleeve 108 (and also the entire jacket 8) scatters and absorbs a very small percentage of X-rays.

In the embodiment of FIG. 3, the envelopes 9 and 12 are respectively subjected to compressive and tensional stresses; therefore, the outer envelope 9 preferably consists of or contains carbon filaments and the inner envelope preferably consists of or contains Kevlar fibers.

The manner of making the envelopes 9 and 12 is preferably identical with or analogous to the aforedescribed presently preferred technique of making the envelope 1*a* or 5. The material of the sleeve 108 and inserts 10, 11 may be identical with the material of corresponding parts of the jacket 4. A presently preferred material for the sleeves 104, 108 is a lightweight synthetic plastic substance, e.g., polyurethane foam.

The pressure vessel 1 is shown in detail in FIGS. 4 and 5. The two main portions 2, 3 of the pressure vessel consist of a homogeneous synthetic plastic material, such as polyurethane foam, and the marginal zone of the main portion 2 has projections or tongues 2*a* which form a frame and extend into a complementary groove 3*a* in the adjacent marginal zone of the main portion 3. The plane P—P in which the main portions 2, 3 of the pressure vessel abut against each other is normal to the plane of FIGS. 2 or 3 and extends between the walls 104*a*, 104*b* of the sleeve 104 or between the walls 108*a*, 108*b* of the sleeve 108. The projections 2*a* of the main portion 2 extend transversely of the plane P—P, i.e., transversely of the direction of insertion or removal of pressure vessel 1 from the compartment 4*a* or 8*a*.

An expandible elastic or flexible sealing element or gasket 14 is inserted into the groove 3*a* so that, when expanded in response to admission of a suitable fluid medium, it bears against the frame 2*a* and/or another part of the main portion 2 as well as against at least one of those surfaces of the main portion 3 which surround the groove 3*a*. The exact construction of means for admitting a fluid into the gasket 14 forms no part of the invention. The sealing means for the confined gas may include two or more gaskets.

A dielectric receptor sheet 15 or an analogous insulating charge-receiving medium can be introduced into the space or gap 19 between the portions 2, 3 through a narrow elongated slot 16 whose width preferably increases in a direction from the gap 19 toward the corresponding narrow outer surface 1A of the pressure vessel 1. Those parts of the main portions 2, 3 which flank the slot 16 are preferably reinforced by suitable inserts 17, 18 consisting of a metallic or other suitable material.

The means for admitting a high Z gas into the gap 19 comprises a conduit 20 which is connected to a source 20A of compressed gas and contains a suitable valve 20B which can be actuated to start or terminate the admission of gas into the interior of the pressure vessel as well as to regulate the pressure of confined gas. The source 20A may constitute or include a pump. Alternatively, the source 20A may constitute a container for a supply of compressed gaseous fluid.

When the gasket 14 is caused to expand, it forms an endless seal around the entire gap 19. As shown in the right-hand portion of FIG. 4, the gasket 14 then seals the outer part of the slot 16 from the gap 19 by bearing against the main portions 2, 3 as well as against the adjacent side of the sheet 15. The length of the sheet 15 is preferably such that, even when properly inserted into the pressure vessel 1, a portion (e.g., 3 inches) thereof extends from the slot 16 so that it can be engaged by suitable advancing or transporting rolls, not shown.

The two major surfaces which flank the upper side and the underside of the gap 19, as viewed in FIG. 4, are overlapped by plates 21, 22 which consist of an electrically insulating material and respectively carry conductive electrodes 24, 23. The electrodes are electrically connected with rivets 25 which are a press-fit in insulating sleeves 26 embedded in the respective main portions 2 and 3 of the pressure vessel. The outer heads of the rivets 25 are electrically connected with blade-like supports 27, 28, and more particularly with conductive layers 29 on the corresponding supports. The layers 29 are electrically connected with terminals 32 shown in FIG. 5. Each of the electrodes 23, 24, layers 29 and terminals 32 may be a printed circuit. The exact manner of forming such electrodes, layers and terminals forms no part of our invention When the imaging chamber is in use, a potential of ± 20 kilovolts is applied to the layers 29; therefore, the outer sides of the layers 29 are overlapped by suitable shields 30, 31.

Each layer 29 may consist of several strip-shaped conductors 29*a*–29*n* (three shown in FIG. 5). Each such strip-shaped conductor is electrically connected with a discrete rivet 25, with a discrete terminal 32, and with a discrete strip-shaped portion of the respective electrode (see the strip-shaped electrode portions 23*a*, 23*b* in FIG. 5). Each electrode portion is a frame-like element, and a different potential is applied to each electrode element. The potential varies stepwise from element to element of the respective electrode 23 or 24. The elements of each electrode are covered by layers of a semiconductive material. Each electrode (when considered in its entirety) is a flat body which may be constructed in a manner as disclosed, for example, in U.S. Pat. No. 3,859,529 to Proudian et al. As far as its electrical properties are concerned, each electrode can be said to constitute a spherical electrode; therefore, the electrodes promote the flow of ions which develop in the gap 19 and advance in the direction indicated by arrow A denoting the direction of incident X-rays. The ions impinge on and are retained by the adjacent surface of the dielectric receptor sheet 15 which overlies one of the electrodes 23, 24. The thus obtained latent image of the body through or around which the X-rays pass on their way toward the pressure vessel 1 is thereupon developed with toner particles in a manner well known from the art.

The high voltage supply includes cables 33 and 133 (FIG. 1) which are connected to an outlet 35 having sockets 34*a*, 34*b* for reception of the blade-like supports 27, 28 and the layers 29 thereon. The sockets 34*a*, 34*b* contain conductors (not shown), one for each strip (29*a*–29*n*) of the respective layer 29. The wires 33*a*, 133*a* of the cables 33, 133 are connected with discrete contacts in the respective sockets 34*a*, 34*b*.

The parts 32, 25, 29 can be said to constitute two composite conductor means each having a first portion connected to the elements of the respective electrode and a second portion which extends from the vessel 1 and jacket 4 and into the respective socket 34*a* or 34*b*. Thus, and referring to FIG. 5, the first portion of conductor means for the elements 23*a*, 23*b*, etc. of the electrode 23 includes the terminals 32, the rivets 25 and those portions of the strips 29*a*, 29*b*, 29*c*, etc. which are overlapped by the shield 31 of FIG. 4. The outer portion of such conductor means includes the exposed portions of the strips 29*a*, 29*b*, 29*c*, etc., i.e., those portions of the strips which are applied to the blade-like support 28.

Each of the jackets 4 and 8 contains a suitable device 35 (see FIGS. 2 and 3) for limiting the amount of incident X-rays. The device 35 is connected with the controls for the source of X-rays by means of conductors 36, 37. A suitable radiation regulating device is IONTOMAT produced by West German firm Siemens AG (see pages 36–37 of "Medizinische Technik," 1975 Edition, published by Siemens AG). Reference may also be had to pages 242–243 of "Leitfaden der medizinischen Rontgentechnik" published 1961 by Philips Technische Bibliothek. In many countries, such devices are prescribed by the authorities in order to protect the patients from excessive exposure to X-rays.

The device 35 of FIGS. 2 and 3 is shown very schematically. As a rule, a IONTOMAT is an elongated rectangular instrument which presents a relatively large surface to incident X-rays. Moreover, it is customary to employ two or more devices 35 in each cassette, i.e., each of the sleeves 104, 108 may contain two or more such devices to further reduce the likelihood of excessive exposure to X-rays when the improved imaging chamber is used in a radiological apparatus.

The invention hereinabove described may be varied in construction within the scope of the claims, for the particular imaging chambers selected to illustrate the invention are but a few of many possible embodiments of the same. The invention, therefore, is not to be restricted to the precise details of the structure shown and described.

Without further analysis, the foregoing will so fully reveal the gist of the present invention that others can, by applying current knowledge, readily adapt it for various applications without omitting features which fairly constitute essential characteristics of the generic and specific aspects of our contribution to the art and, therefore, such adaptations should and are intended to be comprehended within the meaning and range of equivalance of the claims.

What is claimed is:

1. In an X-ray system wherein information is recorded as a pattern of electrostatic charges carried by an insulating charge-receiving medium while the medium is placed into a gap between spaced-apart first and second electrodes and the gap is filled with a compressed ionizable gas which has a high Z, an imaging chamber adapted to be exposed to a pattern of X-rays and comprising a pressure vessel which receives said electrodes and defines said gap, said vessel including sealing means surrounding said gap to confine the compressed gas therein whereby the gas in said gap tends to expand and to deform said vessel; and means for preventing deformation of said vessel, including a jacket having a compartment for said vessel.

2. An imaging chamber as defined in claim 1, wherein at least a portion of said pressure vessel consists of a lightweight material which is a poor absorber and scatterer of X-rays.

3. An imaging chamber as defined in claim 2, wherein said lightweight material is polyurethane foam.

4. An imaging chamber as defined in claim 1, wherein at least a portion of said jacket consists of a highly deformation-resistant synthetic plastic material and fibrous reinforcements embedded in said plastic material.

5. An imaging chamber as defined in claim 1, wherein said jacket is a prism and said compartment has a shape which is complementary to the outline of said pressure vessel.

6. An imaging chamber as defined in claim 5, wherein said compartment has first and second ends located opposite each other and at least one of said ends is open to permit insertion or withdrawal of said pressure vessel.

7. An imaging chamber as defined in claim 1, wherein said pressure vessel comprises two main portions and said gap is disposed between said main portions.

8. An imaging chamber as defined in claim 7, wherein said main portions of said pressure vessel have marginal zones which abut against each other and surround said gap.

9. An imaging chamber as defined in claim 8, wherein said vessel is insertable into and removable from said compartment in a predetermined direction, one of said marginal zones having projections extending transversely of said direction and the other of said marginal zones having a groove for said projections.

10. An imaging chamber as defined in claim 1, wherein said sealing means comprises an inflatable gasket.

11. An imaging chamber as defined in claim 1, wherein said pressure vessel comprises first and second main portions, said gap and said electrodes being disposed between said main portions and said vessel being insertable into and withdrawable from said compartment in a predetermined direction, said vessel further comprising first and second electric conductor means and each of said conductor means having a first portion conductively connected with the respective electrode and a second portion extending in said direction beyond the respective main portion and said jacket when said pressure vessel is received in said compartment.

12. An imaging chamber as defined in claim 11, wherein said vessel comprises blade-like supports for said second portions of said conductor means.

13. An imaging chamber as defined in claim 11, wherein each of said electrodes comprises a plurality of discrete elements and further comprising means for applying different electrostatic potentials to said elements of said electrodes, said second portion of each of said conductor means comprising an insulating support and a plurality of discrete conductors provided on said support and connected to discrete elements of the respective electrode.

14. An imaging chamber as defined in claim 13, further comprising an outlet having sockets for said second portions of said conductor means.

15. An imaging chamber as defined in claim 1, wherein said jacket comprises a relatively thin inner envelope surrounding said compartment, a median portion consisting of a homogeneous lightweight material, and a relatively thin outer envelope surrounding said median portion.

16. An imaging chamber as defined in claim 15, wherein said lightweight material is polyurethane foam.

17. An imaging chamber as defined in claim 15, wherein at least one of said envelopes consists of a synthetic plastic material and fibrous reinforcements for said plastic material.

18. An imaging chamber as defined in claim 15, wherein at least one of said envelopes is a tubular body.

19. An imaging chamber as defined in claim 18, wherein said tubular body consists, at least in part, of convoluted fibrous material.

20. An imaging chamber as defined in claim 15, wherein said median portion of said jacket has a substantially elliptical profile and said outer envelope conforms to said profile and consists at least in part of a material having a high tensile strength.

21. An imaging chamber as defined in claim 15, wherein said median portion of said jacket has at least one concave outer surface and said outer envelope follows the contour of said median portion and consists of a highly compression-resistant material.

22. An imaging chamber as defined in claim 1, wherein said jacket includes reinforcing inserts.

23. An imaging chamber as defined in claim 22, wherein said inserts are outwardly adjacent to said electrodes and said gap.

24. An imaging chamber as defined in claim 1, wherein said jacket comprises a median portion, an inner envelope surrounded by said median portion and surrounding said compartment, and an outer envelope surrounding said median portion, one of said envelopes including at least one layer of Kevlar fibers.

25. An imaging chamber as defined in claim 1, wherein said jacket comprises a median portion, an inner envelope surrounded by said median portion and surrounding said compartment, and an outer envelope surrounding said median portion, one of said envelopes having at least one layer of carbon epoxy filaments with a high modulus of elasticity.

26. An imaging chamber as defined in claim 1, further comprising means for measuring the quantity of X-rays which penetrate into said vessel through said jacket.

* * * * *